United States Patent [19]

Guest

[11] Patent Number: 4,597,205

[45] Date of Patent: Jul. 1, 1986

[54] SNOW PLOW CLAMP ASSEMBLY

[76] Inventor: William H. Guest, Guest Industries, Inc., 3601 Winsted Rd., Torrington, Conn. 06790

[21] Appl. No.: 606,928

[22] Filed: May 4, 1984

[51] Int. Cl.[4] ..... E01H 5/06

[52] U.S. Cl. ..... 37/241; 24/514; 24/569; 37/117.5; 37/266; 37/DIG. 12; 172/273; 172/817

[58] Field of Search ..... 37/117.5, DIG. 3, DIG. 12, 37/141 R, 241, 266; 24/490, 514, 569, 580; 172/272, 273, 274, 817

[56] References Cited

U.S. PATENT DOCUMENTS

| | | | |
|---|---|---|---|
| 3,864,793 | 2/1975 | Guest | 24/569 |
| 3,866,342 | 2/1975 | Cooper | 37/DIG. 3 X |
| 3,908,844 | 9/1975 | Duffield | 37/DIG. 3 X |
| 4,043,061 | 8/1977 | Heitman | 37/141 R |
| 4,189,854 | 2/1980 | Haynes | 37/DIG. 3 X |
| 4,420,189 | 12/1983 | von Ruden | 37/117.5 X |

FOREIGN PATENT DOCUMENTS

| | | | |
|---|---|---|---|
| 1084706 | 9/1980 | Canada | 37/117.5 |
| 2249268 | 4/1974 | Fed. Rep. of Germany | 37/117.5 |

*Primary Examiner*—Edgar S. Burr
*Assistant Examiner*—Moshe I. Cohen
*Attorney, Agent, or Firm*—Prutzman, Kalb, Chilton & Alix

[57] ABSTRACT

A clamp assembly for mounting a snow plow to the lip of a loader bucket comprises a pair of receiving frames forming laterally extending slots. A ramp surface is disposed at the apex of the slots. Pivot arms mount a clamp engagement members which may be locked position to secure the lip of a loader bucket received in the slots. A snow plow connects with connector arms which are pivotally mounted to the receiving frames.

17 Claims, 5 Drawing Figures

SNOW PLOW CLAMP ASSEMBLY

BACKGROUND OF THE INVENTION

This invention relates to heavy-duty loading equipment which employs a front loader bucket such as for example earth working equipment used in highway construction. More particularly, this invention relates to a clamp assembly for mounting a snow plow to the lip of a loader bucket.

A number of attachments and clamp assemblies have been developed for mounting to the loader buckets of heavy-duty loading equipment so that the equipment is adapted for performing various auxiliary tasks in addition to the heavy-duty loading task to which the equipment is specifically adapted. Exemplary of such attachments are the multiple tool attachments disclosed in U.S. Pat. No. 3,864,793, which attachments were invented by the inventor of the present invention. The latter patent discloses a plurality of multiple tool attachments which can be efficiently mounted onto the buckets of earth working equipment such as backhoes or loaders. The attachments are adapted to support any of a plurality of various tools. The latter multiple tool attachments have been successful in overcoming many of the deficiencies of prior art attachments which require either the provision of specially designed buckets or substantial modifications to the existing bucket. In addition, the latter multiple tool attachments have been successful in overcoming previous prior art deficiencies wherein the time period expended in mounting and dismounting the attachment is significant, especially in comparison to the actual period of use of the attached tool, and deficiencies wherein the additional flexibility of the loader equipment provided by the prior art attachments is somewhat negated by required permanent fixtures and modifications to the equipment interfering with the normal use and performance of the loader equipment.

The present invention overcomes many of the above-noted deficiencies of prior art attachment mechanisms to provide a new and improved clamp assembly which is especially adaptable for mounting and securing a snow plow to the loader bucket of front loader earth moving equipment. The present invention efficiently exploits for the task of snow removal the recognized capabilities of heavy-duty loading equipment of the type employing a frontally operated loader bucket. The bucket loader/snow plow combination provided by the present invention is advantageous for pushing snow over dividers and walkways and many other similar applications since the cutting edge or working edge of the snow plow is significantly forward of the wheels of the equipment vehicle. In addition, the heavy-duty loading equipment normally has substantial power and traction capabilities and high-speed backing characteristics, and provides substantially 360° vision for the operator. The snow plow clamp assembly of the present invention is especially designed to distribute the stresses exerted on the plow and clamp assembly during snow plowing operations to substantially lessen the likelihood that the clamp assembly will be inadvertantly disengaged from the loader bucket.

BRIEF SUMMARY OF THE INVENTION

Briefly stated, the invention in a preferred form is a clamp assembly which is adaptable for mounting a snow plow to the lip of a loader bucket. The assembly comprises a pair of receiving frames which are positioned in a generally upright aligned spaced relationship to form generally laterally extending slots which are defined by upper and lower bearing edges of the frames. The slots terminate at a rearward apex. A ramp surface is located at each apex in an inclined orientation relative to the upper and lower bearing edges. A pair of support members extend transversely between the frames to rigidly interconnect the frames. A pair of pivot arms are pivotally mounted to the frames. The pivot arms mount a clamp member such as a cup point insert having an outer engagement rim. The clamp members are positionable in each of the lateral slots upon suitable pivoting of the pivot arms. A clamp lock is provided to lock each of the clamp members at a plurality of selected pivot positions. Connector arms connecting the snow plow are pivotally mounted to each of the frames.

Each of the receiving frames preferably comprises a pair of substantially C-shaped parallel plates. The forward portions of the plates adjacent each of the lateral slots are tapered to provide an enlarged opening for the slots. A pivot arm and a connector arm are each mounted between the parallel plates of each receiving frame. The clamp lock includes a fixedly mounted nut and a lock screw which is threadably positionable for limiting the pivotal position of the clamp member. The clamp lock further includes a lock pin which is insertable in a star wheel rigidly coupled to the lock screw and a lock socket alignable with notches in the star wheel to secure the lock screw at an angularly fixed position. A lower support plate transversely extends between the parallel plates of each of the receiving frames. The distance between the pivot axis of the connector arm and the upper portion of the ramp surface is less than the distance between the pivot axis of the connector arm and the support plate.

An object of the invention is to provide a new and improved clamp assembly adaptable for mounting a snow plow to the lip of a loader bucket.

Another object of the invention is to provide a new and improved snow plow clamp assembly which may be quickly and efficiently mounted and dismounted to and from a loader bucket of a type such as employed in heavy-duty earth moving equipment.

A further object of the invention is to provide a new and improved clamp assembly which is adaptable for mounting a snow plow to a loader bucket without requiring a modification or other alteration to the bucket or additional tools to secure the clamp assembly in place.

A yet further object of the invention is to provide a new and improved snow plow clamp assembly which is adaptable for securing a snow plow to a loader bucket and wherein stresses exerted on the assembly during the operation of the snow plow are distributed to prevent inadvertent loosening of the clamp assembly.

Other objects and advantages of the invention may become apparent from the specification and drawing.

DETAILED DESCRIPTION OF THE INVENTION

Figure 1:
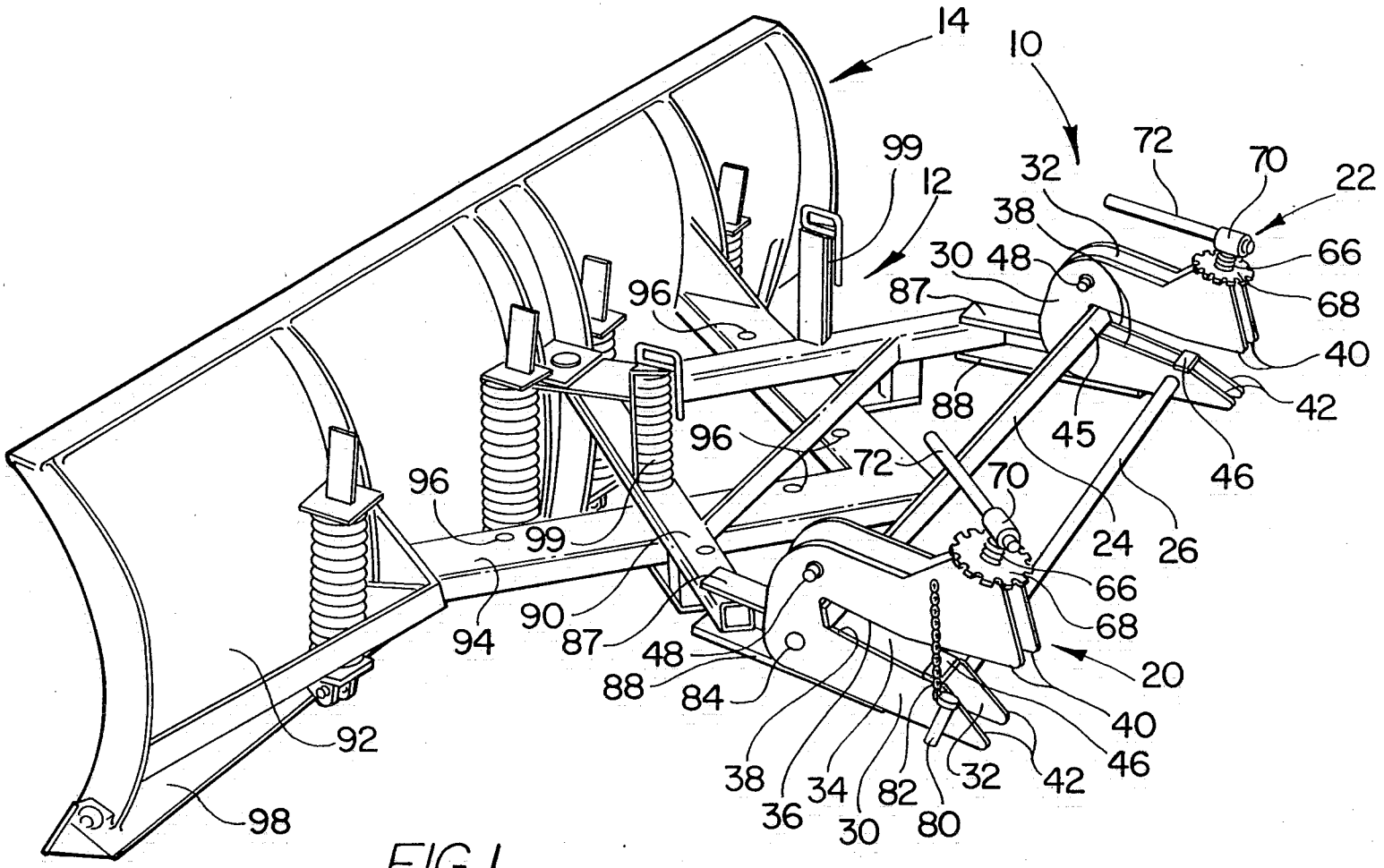
FIG. 1 is generally side perspective view of the snow plow clamp assembly of the present invention together with a snow plow.

With reference to the drawing wherein like numerals represent like parts throughout the several figures, a snow plow clamp assembly in accordance with the present invention is generally designated by the numeral 10. With further reference to FIG. 1, clamp assembly 10 is illustrated in its preferred application wherein the clamp assembly is connected via a frame assembly 12 to a snow plow 14. Frame assembly 12 provides a connecting, positioning, and support structure for snow plow 14. Clamp assembly 10 is especially adaptable for use for mounting and securing a snow plow to the forward lip of a loader bucket of a type which is generally operationally positionable forward of the operator of a loader vehicle (not illustrated) and adaptable for heavy-duty earth moving operations. The clamp assembly functions in an efficient manner so that when conditions dictate, a snow plow such as snow plow 14, may be mounted to a loader bucket by clamp assembly 10 for adapting the loader equipment for the removal of snow or similar materials. A portion of a lip of an exemplary loader bucket is designated by the numeral 16 in FIG. 2. Clamp assembly 10 may be employed with numerous types and models of snow plows. Snow plow 14 is merely exemplary of a suitable snow plow which may be mounted to a loader bucket by the present invention.

Clamp assembly 10 comprises a pair of clamp receiving frames 20 and 22 which are disposed in an aligned spaced relationship. Clamp frames 20 and 22 are positioned in a generally upright orientation for receiving from a forward direction a loader bucket lip which is oriented to be generally parallel to the ground and spaced a few inches therefrom. Clamp frames 20 and 22 are substantially identical and are rigidly interconnected by a transversely extending metal support bar 24 and a heavy-duty metal tube 26. The support bar 24 and the tube 26 are welded or rigidly attached to the clamp frames to provide a sturdy support structure for maintaining the spaced relationship between the clamp frames and the generally upright orientation of the clamp frames, and for reinforcing the clamp assembly during snow plow operations. The clamp assembly is transversely dimensioned so that each of the clamp frames can be positioned between the sides of the corresponding loader bucket.

Figure 2:
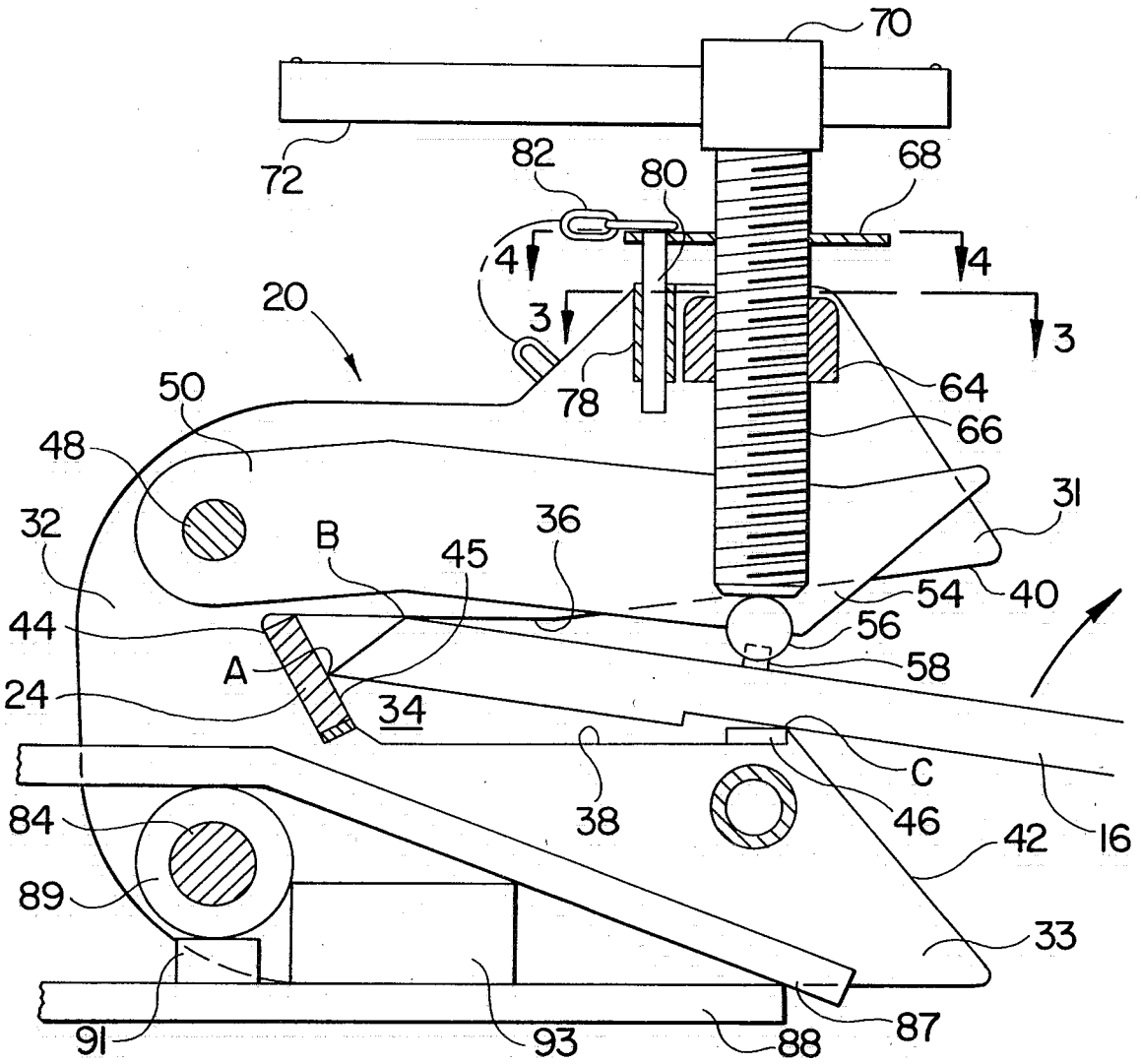
FIG. 2 is an enlarged central sectional view of a portion of the clamp assembly of FIG. 1 together with a lip of a loader bucket to which the clamp assembly is mounted.

Because clamp frames 20 and 22 are substantially identical, a detailed description of clamp frame 20 as set forth below is equally applicable to clamp frame 22 which is not otherwise described in detail. With further reference to FIG. 2, clamp frame 20 includes a pair of parallel, substantially identical, generally C-shaped steel plates 30 and 32 each of which plates essentially form an upper jaw 31 and a lower jaw 33 (plate 30 not illustrated in FIG. 2). The plates of each frame 20 and 22 are aligned in a spaced relationship. The plates cooperate to form a generally centrally located slot 34 extending laterally from the front edge of the plates. Slot 34 is defined by generally lateral bearing edges 36 of upper jaw 31 and generally lateral bearing edges 38 of lower jaws 33. The rear portion of edge 36 is straight. The forward portion of the plates adjacent slot 34 have contour edges 40 and 42 which are forwardly tapered to provide an enlarged opening into slot 34 for guiding the bucket lip rearwardly into the slot. Upper contour edges 40 have a slight upward taper from bearing edges 36. Lower contour edges 42 have a more pronounced downward taper from bearing edges 38. Slot 34 rearwardly terminates at a slot apex 44. Support bar 24 extends transversely through the slot and is positioned at apex 44 to present a forwardly facing ramp surface 45. Ramp surface 45 is angularly inclined relative to upper bearing edges 36 and lower bearing edges 38 to form a rearward upper acute angle with the bearing edge 36. In preferred form, the angle is on the order of 30 degrees. Slot 34 is dimensioned for receiving the forward portion of a loader bucket lip 16 as best illustrated in FIG. 2. The ramp surface 45 and bearing edges 36 form V-structures for driving the forward top edge of the bucket lip against bearing edges 36 to wedgingly lock the lip into the slots 34 as further described below.

Support 26 is welded at a forward portion of opposing jaws 33 of the two inner positioned plates of frames 20 and 22 slightly below the opening to slot 34. A support plate 46 is mounted across the top of a forward portion of edges 38 and transversely extends from plate 30 to plate 32 to form a lower support member for lip 16. Support plate 46 generally vertically aligns with tube 26 to enhance the structural integrity of the clamp assembly.

Plates 30 and 32 each have at upper rear portions aligned openings which retain opposite ends of a pivot pin 48. Pivot pin 48 may be axially secured in position between the plates by any of a number of conventional means. In a preferred form, the pivot pin has an enlarged retainer head at one end and a diametral bore at the other end for receiving a cotter pin 52. A pivot arm 50 is mounted at one end to pivot pin 48 and is disposed between plates 30 and 32 for pivotal motion therebetween in a plane generally parallel to the plates. Pivot arm 50 may be of a generally bifurcated form having transversely spaced plate members which are adjacent and parallel to plates 30 and 32. Pivot arm 50 includes an upwardly tapered forward tip 54.

The pivot arm 50 is contoured for accommodation of a transversely oriented cylindrical bar 56 which axially extends between the spaced plate members of the pivot arm. Bar 56 is preferably welded to each of the plate members of pivot arm 50. Upon suitable pivoting of pivot arm 50, bar 56 is generally alignable with support plate 46. A cup point insert 58 is pressed into an outer radial slot machined in bar 56. The outer end of insert 58 forms an engagement rim which functions as a clamp engagement member to bitingly clamp against the inside surface of a forward portion of the lip 16 of a loader bucket as illustrated in FIG. 2. Insert 58 is accordingly preferably manufactured of a rugged metallic material. In an alternate embodiment, the outer end of insert 58 may be serrated or include a plurality of engagement teeth (not illustrated) which project generally radially toward support plate 46 for engaging the loader bucket lip. In the unmounted mode, the insert 58 normally rests on the support plate 46. The forward tip 54 of the pivot arm 50 is tapered so that when the lip 16 of the loader bucket is received in slot 34, the edge of the lip engages the tip 54 and forces the pivot arm 50 and insert 58 to ride over the lip.

Figure 3:
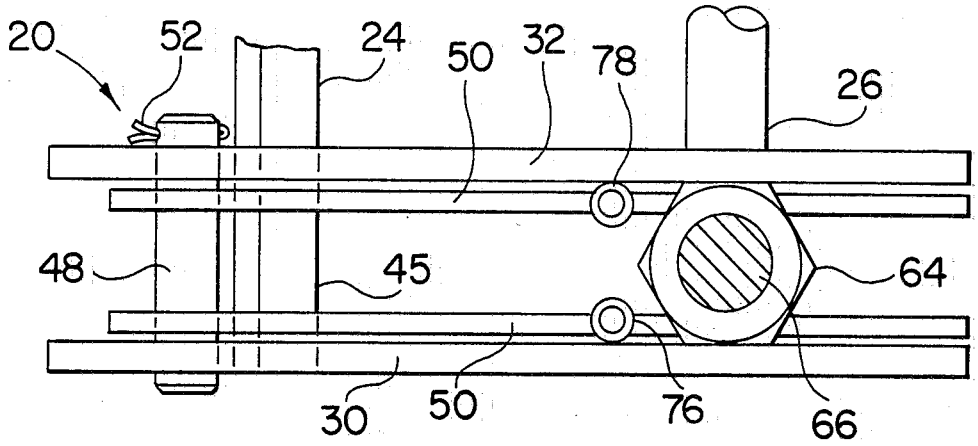
FIG. 3 is a top sectional view taken along the line 3—3 of FIG. 2.
Figure 4:
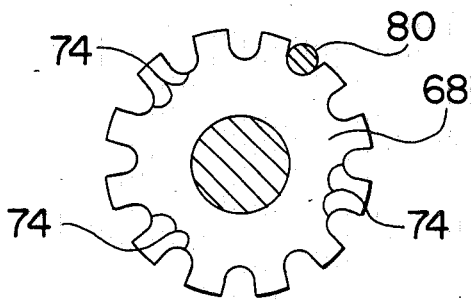
FIG. 4 is top sectional view taken along the line 4—4 of FIG. 2 and illustrating a portion of a clamp lock employed in the present invention.

With reference to FIG. 3, a hexnut 64 is welded in fixed position between opposing faces of plates 30 and 32. Hexnut 64 is interiorly threaded for receiving a threaded rod or lock screw 66 which is threadably positionable along a generally vertical axis through hexnut 64. The lower end of lock screw 66 is positionable for engagement against a portion of bar 56 for controllably limiting the upper pivotal position of the pivot arm 50 and hence the position of the engagement portion of clamp insert 58 in slot 34. A star wheel 68 is rigidly coupled to an upper portion of lock screw 66. Star wheel 68 is positioned above the top of plates 30 and 32. A yoke 70 is mounted above the star wheel 68 for receiving a slidable handlebar 72. Handlebar 72 is employed to facilitate the rotatable positioning of lock screw 66 and is slidable to avoid interference with the sides of the loader bucket. It will be appreciated that the foregoing described clamp provides a means for clamping the clamp insert 58 in position against one surface of the lip of a loader bucket received in slot 34.

Twelve equiangularly spaced notches 74 are formed around the circumference of star wheel 68. A pair of tubes 76 and 78 forming longitudinally extending sockets are each located so that the sockets align with a notch 74 upon selective angular positioning of the star wheel. Tubes 76 and 78 are welded at opposite sides of frames 30 and 32 at positions so that when an angularly positionable notch aligns with the socket of one of the tubes, the socket of the other tube is positioned midway between a pair of adjacent notches. A lock pin 80, which may be conveniently attached to the clamp frame by a chain 82, may be inserted into an aligned notch and socket to lock the star wheel and hence the lock screw in a fixed angular position to thereby lock the clamp insert in an engaged position against the loader bucket lip. The sockets of tubes 76 and 78 and notches of star wheel 68 provide 24 equiangular lock positions for each rotation of lock screw 66.

Figure 5:
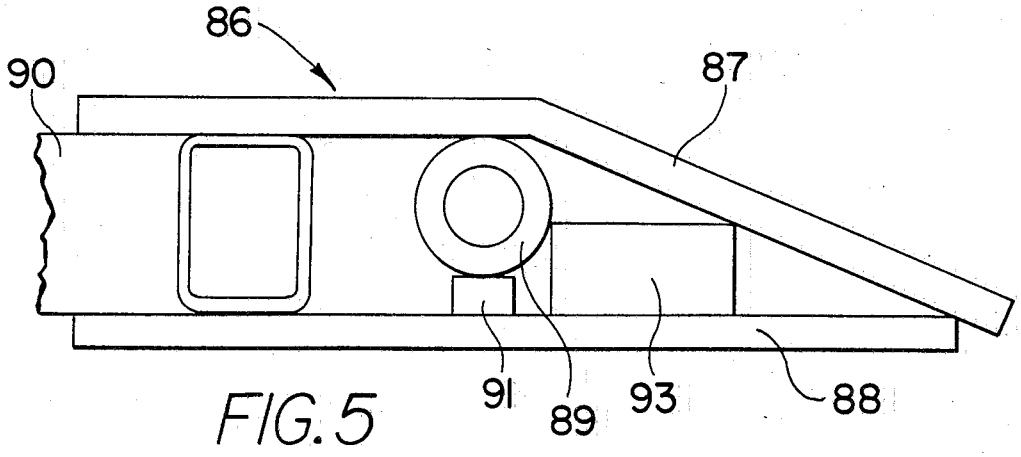
FIG. 5 is an enlarged side view of a connector arm assembly of the snow plow clamp assembly of FIG. 1.

An axle 84 is retained in aligned openings formed at a lower rear portion of plates 30 and 32. Axle 84 extends transversely between plates 30 and 32 and is generally parallel with pivot pin 48. Axle 84 mounts connector arm 86 for limited pivotal positioning of the arm relative to the plates 30 and 32. With further reference to FIG. 5, connector arm 86 has a rearwardly projecting bifurcated configuration formed by spaced plates 87 and 88 which cooperate to receive and connect an end of a support frame member 90 of the snow plow frame assembly 12. A tube 89 for receiving axle 84 is secured between plates 87 and 88. A pair of rigid reinforcement members 91 and 93 may be employed to rigidly interconnect the tube 89 and plates 87 and 88. Upper plate 87 is preferably bent so that plates 87 and 88 intersect at a forward location. When the clamp assembly is elevated, the weight of the snow plow is transferred to clamp frames 20 and 22 through connector arms 86 and axles 84 urging the connector arm to pivot in the counterclockwise direction of FIG. 2. Plate 87 extends forwardly a sufficient distance so that the upper surface of plate 87 contacts the lower portion of support plate 46 thus forming a stop which limits the pivotal motion of the connector arm 86 relative to the clamp frames. In the plowing mode, the connector arms 86 are angularly pivotal about axle 84 on the order of 60 degrees relative to the clamp frames to allow the snow plow to essentially free float during operation.

The frame assembly 12 may be any of a variety of forms such as an A-frame/V-frame configuration as illustrated in FIG. 1. The latter configuration is adaptable for pivotally mounting the blade of a snow plow and for angularly adjusting the snow plow blade relative to the clamp assembly. In the illustration of FIG. 1 an A-frame 90 is pivotally connected at the frame apex to the snow plow blade 92. A V-frame 94 rearwardly extends from the snow plow. The legs of the A-frame 90 and the V-frame 94 include a plurality of slots 96 which are alignable for selective angular positioning of the snow plow blade. The snow plow may incorporate additional features such as a spring loaded trip edge 98, spring loaded position pins 99, and heavy-duty reinforcement members.

With further reference to FIG. 2, the foregoing described clamp assembly 10 functions in an efficient manner to mount and securably clamp the snow plow 14 to the lip of a loader bucket such as employed in heavy-duty earth moving equipment. A single operator can mount or dismount the clamp assembly in a time period on the order of a few minutes or less. The clamp assembly is placed on the ground in the general upright orientation illustrated in FIG. 1 and FIG. 2. The bucket lip 16 is inserted into the slots 34 from a general right to left direction for the clamp assembly orientation illustrated in FIG. 2. It will be appreciated that the insertion is essentially accomplished by the equipment operator positioning the loader bucket in a lowered position wherein the bucket lip is approximately parallel to the ground and spaced a few inches therefrom and driving the loader equipment in a forward direction toward the clamp assembly. The clamp assembly and loader bucket are oriented so that the front of the slots 34 open toward the front of the loader bucket. The bucket is preferably positioned in a substantially level orientation so that the forward portion of the lip is approximately three inches above ground level although a precise bucket orientation is not required.

In practice, the operator of the front loader equipment may not have complete visibility of the clamp assembly as the loader bucket closely approaches the clamp assembly. The contour edges 40 and 42 of the clamp frames function to guide the laterally advancing lip into the laterally extending slots 34. Because of the visibility problems and the difficulty in accurately positioning the level of the bucket lip, it is probable that the lip will not initially align with the slots 34. Thus, the contour edges at the opening of the slots may greatly facilitate the mounting of the clamp assembly.

It will be appreciated that the clamp assembly is transversely dimensioned so that upon sideways alignment of the loader bucket and the clamp assembly and insertion of lip 16 in slots 34, both clamp frames 20 and 22 are positioned interiorly of the sides of the loader bucket. Naturally, the clamp assemblies will be correspondingly dimensioned according to the dimensions of the loader bucket to which the assembly is to be mounted and also to some extent the length of the snow plow blade. In one embodiment of the invention, the transverse dimension of the clamp assembly is approximately 5 feet, and the length of the snow plow blade is approximately 10 feet.

The lip 16 is advanced toward the apexes 44 of slots 34 so that the lip eventually engages ramp surfaces 45 at the rear of the slots. The support bar ramp surfaces 45 are inclined to force the rearwardly forced forward edge of lip 16 to ride the ramp surfaces 45 thereby upwardly rearwardly guiding the lip into contact with the bearing edges 36 of the clamp frames. As illustrated in FIG. 2, in the optimum mount position the bucket lip 16 is essentially wedged into the slots 34 to engage the clamp frames at position A of surface 45, position B of bearing edge 36, and position C of support plate 46.

After the bucket lip is sufficiently inserted into the slots, the bucket is pivotally retracted approximately 30°–45° in the direction of the arrow of FIG. 2. If the forward edge of the lip has not fully reached the latter described optimum position as illustrated in FIG. 2 for each of the clamp frames, the retracting of the bucket and the weight of the clamp assembly and snow plow will cause the clamp assembly to slide downwardly over the lip so that the lip will be rearwardly forced to the optimum mount position for both frames 20 and 22. During the process of retracting the bucket, the snow plow will be lifted via the clamp assembly engagement even though the clamp assembly has yet to be fully secured. It should be noted that during the bucket retraction, the downward pivoting of the snow plow about axle 84 will be limited by the interaction of plates 87 with the underside portions of support plates 46 of each of the clamp frames.

After the bucket lip is positioned at the optimum mount position, the operator may then dismount from the cab of the front loader equipment and proceed to manually tighten each of the lock screws 66. The lock screws are tightened by application of a suitable manually applied torque to handle bars 72 until the lip 16 is securably clamped between clamp insert 58 and the support plate 46. When the lock screw of each clamp frame is sufficiently tightened and a notch 74 is angularly aligned with the socket of either tube 76 or 78, a lock pin 80 is inserted through the aligned notch into the socket to lock the lock screw in a fixed angular orientation thereby locking the clamp to secure the received bucket lip. As previously described, the notches and locking tubes are oriented so that a selected locking position is provided for every 1/24 of a revolution of lock screw 66. It will be appreciated that the slideable handles 72 allow for the clamp assembly to be mounted and tightened even though the sides of the loader bucket are relatively close to the sides of the clamp frames 20 and 22.

When the mounted snow plow is employed to displace snow or other similar function, the snow plow clamp assembly functions to distribute stresses exerted on the snow plow and clamp assembly to prevent inadvertant disengagement of the clamp assembly at the clamp interface; i.e., clamp insert/lip/support plate engagement. The snow plow 14 is pivotally mounted to the clamp assembly via connector arms 86 by means of axle 84. During operation the snow plow essentially free floats about axle 84. It will be appreciated that the rearward forces exerted against the plow from the forward force of the plow against a material to be displaced urge the clamp assembly 10 to rotate about axle 84 in the counter clockwise direction of FIG. 2. Consequently, an upward force is exerted against the bottom of the bucket at contact position C. The distance between the pivot axis of axle 84 and position A of surface 45 is relatively short in comparison to the distance between the pivot axis of axle 84 and position C of support plate 46. This latter relationship functions to reduce the upward forces which would be otherwise exerted on the bottom portion of the loader bucket and alleviate stresses at the clamp interface which would tend to loosen the clamp engagement.

The pivot arms 50 are made of rugged materials and are configured and positioned to withstand relatively high levels of stress. If a snow plow impacts against an object at one side of the plow blade, the bucket lip is secured in slot 34 by the V-structure of the ramp surface 45 and the bearing edges 36 of the clamp frame closest the point of impact even though substantial reaction forces are exerted against the bucket lip. The forward edge of the lip and the clamp frame tend to act as a pivot point for the clamp assembly. The forces resulting from such an impact tend to force the other clamp frame forward. However, the pivot arm of the other clamp frame is adapted to withstand the tendency of the plow to disengage the clamp assembly under such impact conditions. Also, the lock screws 66 do not directly contact the loader bucket, and thus are not as susceptible to deformation due to high intensity impact of the snow plow.

While a preferred embodiment of the foregoing clamp assembly has been set forth for purposes of illustration, the foregoing description should not be deemed a limitation of the invention herein. Accordingly, various modifications, adaptations, and alternatives may occur to one skilled in the art without departing from the spirit and scope of the present invention.

What is claimed is:

1. A clamp assembly adaptable for mounting a snow plow to the lip of a loader bucket comprising:

a pair of receiving frames disposed in a generally upright spaced relationship and forming generally laterally extending slots defined by upper and lower contact means and a rearward slot apex;

ramp means at each said apex disposed in an inclined orientation relative to said upper and lower contact means to engage a bucket lip received in said slot so that said lip is urged into a secure wedge type engagement with said ramp means, upper contact means and lower contact means;

support means transversely extending between said receiving frames to rigidly interconnect said frames;

clamp means mounted to the receiving frames comprising a pivotally mounted clamp member positionable to clamp said lip to said frames;

lock means to lock each said clamp means at a plurality of selected positions; and connector means to pivotally mount a snow plow to said frames.

2. The clamp assembly of claim 1 wherein each said frame comprises a pair of generally C-shaped parallel plates.

3. The clamp assembly of claim 2 wherein the forward portions of the plates adjacent each said lateral slot are forwardly tapered to provide enlarged openings to said slots.

4. The clamp assembly of claim 2 wherein the clamp members are each mounted between the parallel plates of a receiving frame for pivotal movement.

5. The clamp assembly of claim 1 wherein the laterally extending slots are dimensioned so that the lip of a loader bucket received therein may be securely wedged against the upper and lower contact means and the ramp means.

6. The clamp assembly of claim 1 wherein the clamp lock means comprises a threaded clamp down means for engageably limiting the position of the clamp means.

7. The clamp assembly of claim 6 wherein the lock means further comprises a lock pin, a lock wheel mounted to said lock screw and having a plurality of circumferentially located notches, and at least one tube member having a socket alignable with said notches so that upon alignment of a notch and a socket, the lock pin is insertable in said notch and socket to secure the lock screw in an angularly fixed position.

8. The clamp assembly of claim 7 further comprising two tube members each having sockets alignable with said notches and wherein the notches and the sockets define a plurality of equiangular spaced lock positions.

9. The clamp assembly of claim 1 wherein the ramp means is formed by a transversely extending bar connecting each of said receiving frames and said support means includes said bar.

10. The clamp assembly of claim 1 wherein said lower contact means comprises a support plate extending transversely in each said frame.

11. The clamp assembly of claim 10 wherein the distance between the pivot axis of the connector means and the ramp means is less than the distance between the pivot axis of the connector means and the support plate.

12. The clamp assembly of claim 7 further comprising a slideable handle mounted to an upper portion of the lock screw for rotatable positioning thereof.

13. The clamp assembly of claim 1 wherein said clamp member comprises a bar and a hardened element mounted to said bar and adapted to bite into said lip to clamp the lip against the lower contact means.

14. A clamp assembly adaptable for mounting a snow plow to the lip of a loader bucket comprising:

a pair of receiving frames disposed in a spaced relationship and forming a pair of aligned generally laterally extending slots defined by upper and lower contact means;

ramp means forming a V-shaped engagement structure with the upper contact means to engage a bucket lip received in said slots so that when said lip is rearwardly forced against said ramp means, the lip is urged into a wedge type engagement with said ramp means and said upper and lower contact means;

support means transversely extending between said receiving frames to rigidly interconnect said frames;

clamp means mounted to said receiving frames and mounting a clamp member selectively positionable to clamp against a bucket lip received in each said lateral slot;

lock means to lock said clamp member at a plurality of selected positions;

a pair of connector arms each pivotally mounted to to one of said receiving frames, each receiving frame comprising a pair of spaced parallel plates, said clamp means and connector arms being pivotally mounted to said plates for pivotal motion therebetween; and a snow plow including a support frame, said support frame connecting each said connector arm.

15. The clamp assembly of claim 14 wherein the plates are forwardly tapered to form enlarged openings of the lateral slots, the clamp member being positionable from a position opposite the lower contact means.

16. A clamp assembly adaptable for mounting a snow plow to the lip of a loader bucket comprising:

a pair of receiving frames disposed in a spaced relationship and forming a pair of aligned generally laterally extending slots partially defined by an upper contact means and having a forward enlarged portion and rearward restricted portion partially defined by the upper contact means;

a transverse support plate forming a lower contact surface at a forward portion of the restricted slot portion;

ramp means forming a ramp surface which is inclined at an acute angle to the upper contact means to engage a bucket lip received in said slots so that when said lip is rearwardly forced against said ramp means, the lip is urged into a wedge-type engagement with said upper contact means, said lower contact surface and said ramp means;

clamp means comprising a pivotally mounted clamp member selectively positionable to clamp against a bucket lip received in each said lateral slot; and connector means pivotally mounted to said frames and adaptable for connection with a snowplow, the distance between the pivot axis of the connector arm means and the ramp means being less than the distance between the pivot axis of the connector arm means and the support plate.

17. The clamp assembly of claim 16 wherein the clamp member is generally positionable for alignment with the support plate.

* * * * *